United States Patent [19]

Kinsey

[11] 3,952,461

[45] Apr. 27, 1976

[54] MULTI-LAYER WALLS FOR FRAMELESS BUILDINGS FORMED FROM EXTRUDED ALUMINUM OR PLASTIC INTERLOCKING WALL ELEMENTS

[76] Inventor: Lewis R. Kinsey, 108 S. 25th St., Phoenix, Ariz. 85034

[22] Filed: Dec. 26, 1974

[21] Appl. No.: 536,449

[52] U.S. Cl. ..... 52/57; 52/262; 52/270; 52/588; 52/731

[51] Int. Cl.[2] ..... E04B 7/00; E04B 1/343

[58] Field of Search..... 52/270, 262, 588, 730–731, 52/309, 90, 94, 57

[56] References Cited

UNITED STATES PATENTS 3,452,498 1/1969 Kinsey ..... 52/262

3,562,992 2/1971 Kinsey ..... 52/588

*Primary Examiner*—Ernest R. Purser
*Assistant Examiner*—James L. Ridgill, Jr.
*Attorney, Agent, or Firm*—Warren F. B. Lindsley

[57] ABSTRACT

Novel wall construction for frameless, multi-story buildings erected from interlocking multi-layer wall elements formed of aluminum or plastic extrusions which when snapped together in proper sequence form insulated, sound-proof inner and outer walls with ceiling and floor support for industrial, commercial and residential building purposes.

2 Claims, 28 Drawing Figures

MULTI-LAYER WALLS FOR FRAMELESS BUILDINGS FORMED FROM EXTRUDED ALUMINUM OR PLASTIC INTERLOCKING WALL ELEMENTS

BACKGROUND OF THE INVENTION

This invention relates to multi-layer walls for building purposes formed of aluminum or plastic extrusions which may be snapped together to form, when assembled in proper sequence, insulated, sound-proof inside and outside wall structures which support ceiling and floors of a multi-story building structure. More particularly, this invention is directed to novel multi-layer walls formed from only a few different extruded structural elements which are pre-cut, formed and shaped to fit together in an interlocking manner with a minimum of tools to form a variety of frameless, multi-story buildings which may be used for home, office, business, church or other building use.

FIELD OF THE INVENTION

This invention is particularly directed to the novel, multi-layer wall structure for building purposes formed from extruded wall elements which fit and interlock together to form new wall structures for frameless multi-story building complexes.

DESCRIPTION OF THE PRIOR ART

Extruded aluminum structural elements which snap together to form individual building components have been known as evident from U.S. Pat. Nos. 3,452,498 and 3,562,992 but heretofore none has been designed for assembling multi-layer wall structures for multi-story frameless buildings. Thus, it is desirable from an economic point of view to provide multi-layer walls formed from a few aluminum or plastic extrusions which are snapped together in an interlocking manner to form building complexes limited only by the artistic ability of the builder.

In accordance with this invention, new and improved extruded wall elements have been disclosed which when assembled in the manner disclosed form multi-wall buildings such as, for example, town houses, apartment buildings, business complexes, hospitals, churches and the like all with the same dies. The extruded interlocking forming multi-layered walls for multi-story frameless buildings may be permanently colored when constructed to eliminate painting. The floors, walls, ceilings and roofs of the buildings are all supported by the novel wall structure and are built with pre-cut extruded parts which interlock together to form substantially maintenance-free buildings without the high cost and skill required to assemble the prior art buildings.

Heretofore, a large variety of special tools, wrenches clamps and the like were required to put prefabricated buildings together involving highly skilled labor. Further, the known prefabricated steel and aluminum building components are difficult to handle, move, and set in place, necessitating the use of heavy, costly equipment.

Still further, the former metal building structures were difficult to pre-pack with insulating material and the resulting buildings usually required a frame to support the walls, floors, ceiling and roof components.

SUMMARY OF THE INVENTION

It is, therefore, one object of this invention to provide new and improved extruded structural wall elements which may be interlocked to form a frameless one or multi-story building complex with economy of materials and efficiency in labor heretofore unmatched.

Another object of this invention is to provide an all aluminum multi-story building which is easy to assemble or disassemble and move with a minimum of tools.

A further object of this invention is to provide a novel multi-layer wall structure for a frameless complex formed of extruded parts wherein the lower story structural elements interlock with the juxtaposed upper story structural elements without the use of connectors.

A still further object of this invention is to provide a multi-story building without the use of a frame by designing the walls to be the load carrying members.

A still further object of this invention is to provide interlocking extruded multi-layer wall components formed with a few dies which components when assembled form one or multi-story building complexes of a variety of architectural designs.

A still further object of this invention is to provide novel multi-layer walls formed from extruded parts which snap together to form novel weight supporting walls.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawing, in which:

FIG. 6 is a cross-sectional view taken along the line 6—6 of FIG. 1A showing the snap-together box structural building elements forming the corner pieces of the building complexes;

DESCRIPTION OF THE PREFERRED EMBODIMENT

Figure 1A:
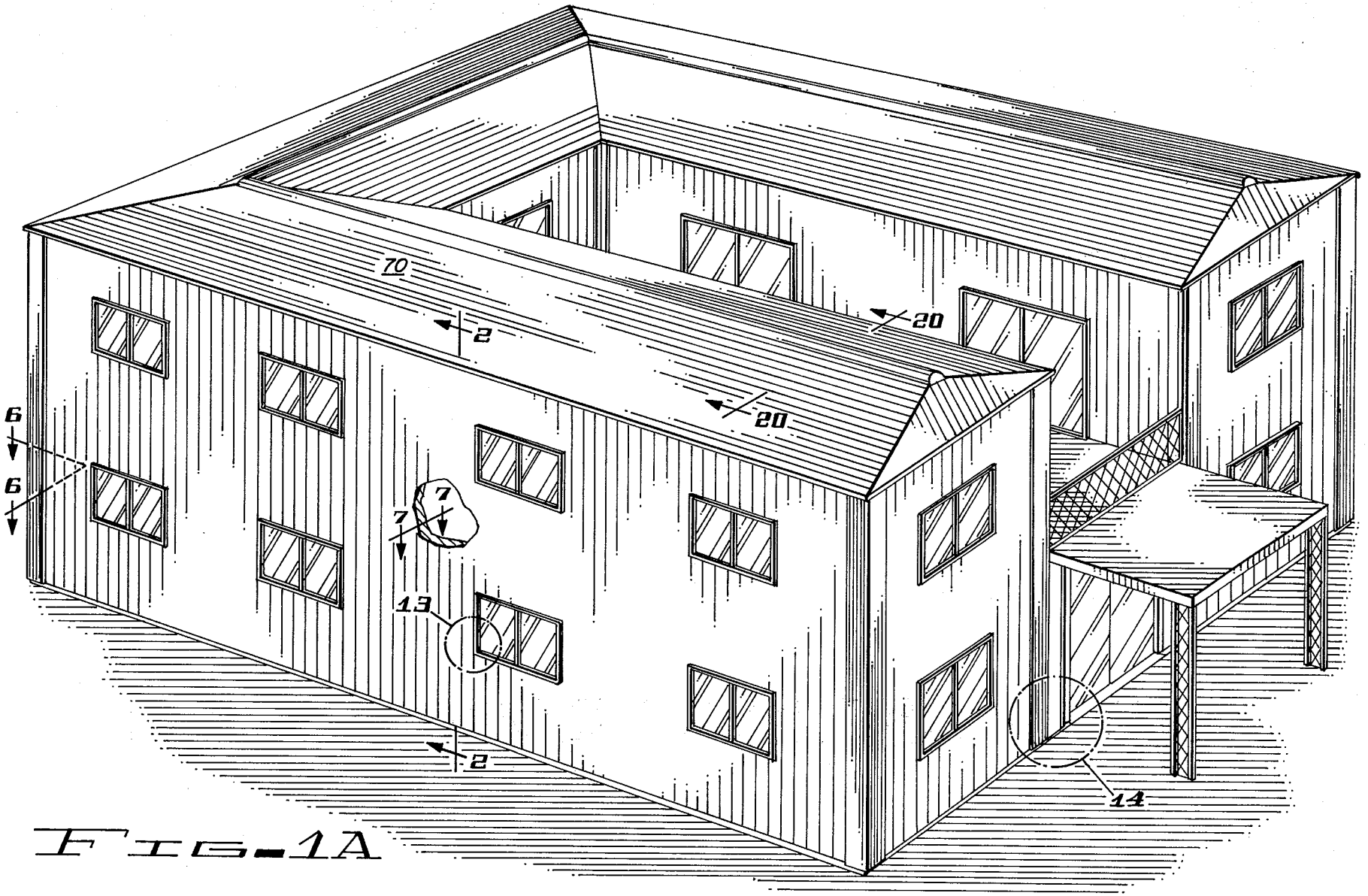
FIG. 1A is a perspective view of a multi-story building complex embodying the invention.
Figure 1B:
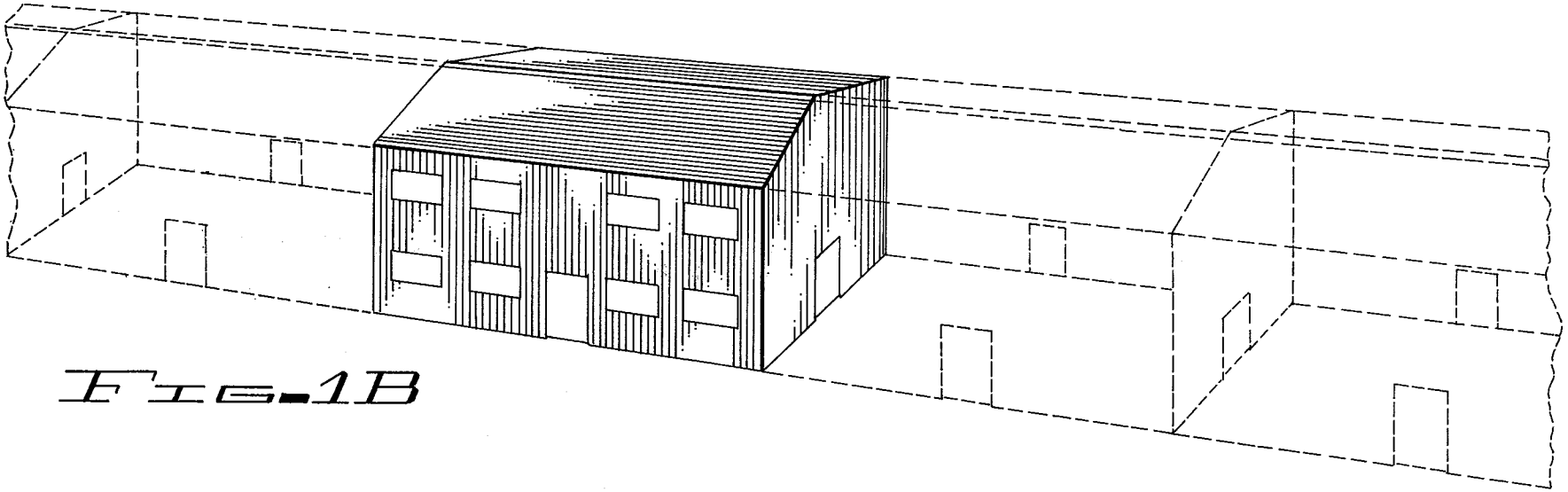
FIG. 1B is a perspective view of an eight unit building complex to which additional units may be added as shown in dash lines.
Figure 1C:
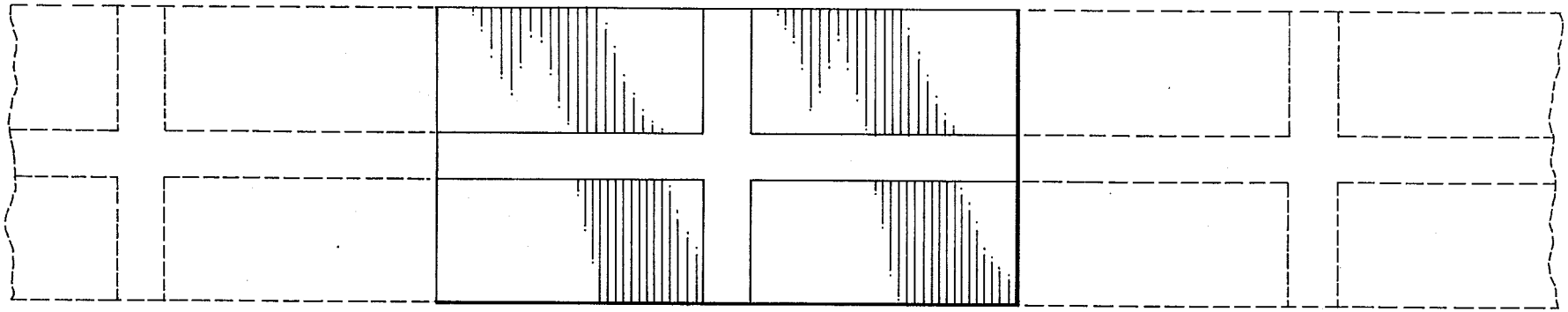
FIG. 1C is a floor plan view of the building complex shown in FIG. 1B with dash lines illustrating add on structures.

Referring more particularly to the drawings by characters of reference, FIGS. 1A, 1B and 1C disclose a building complex which is merely shown for purposes of illustrating one of the many building complexes that are possible to assemble with the inventive concepts disclosed. Industrialization in housing production is especially needed in order to reduce the costs of the buildings through savings in labor, financing and materials. Skilled labor particularly adds a sizable amount to the price of any building complex.

The building shown in the drawings is intended to illustrate the use of the novel extruded multi-wall members disclosed in one building complex, the assembly of which can be varied to modify the outside and inside appearance of the building complexes assembled without modification of the basic building wall elements disclosed.

GENERAL ASSEMBLY

The assembly of the multi-story aluminum building disclosed or any of the other building or complexes capable of being built with the teaching of this invention is basically the fitting together of pre-cut extrusions in the proper sequence.

Figure 2:
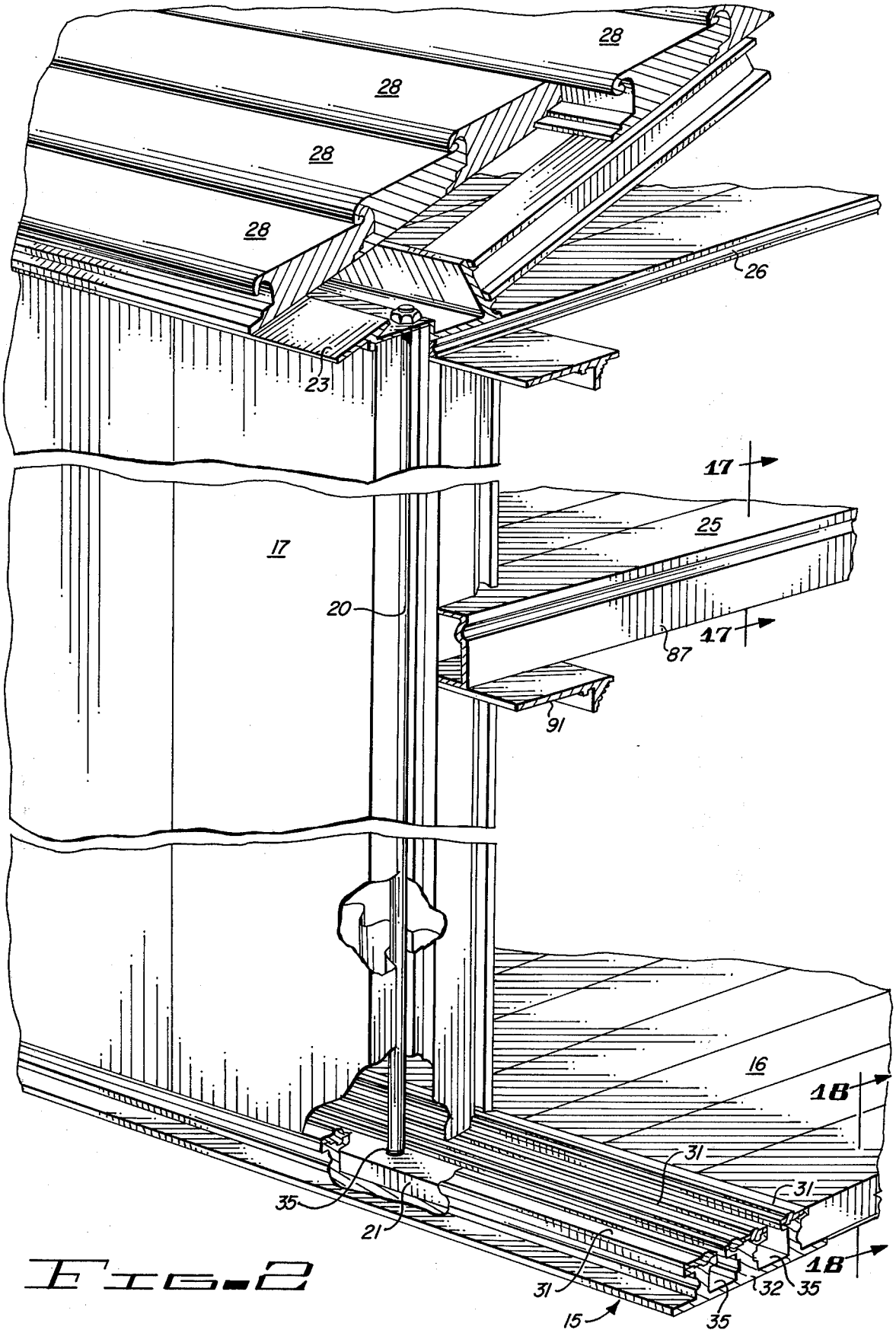
FIG. 2 is a partial perspective view of the building complex shown in FIG. 1A taken along the line 2—2.

As illustrated in FIG. 2, the sill plate 15 is assembled and positioned in the desired floor plan on a suitable slab or footing; this assembly forms the outline of the building and is the bottom foundation for all the walls. The floor extrusion 16 is then laid out on the sill plate 15. After the floor is in place, the walls 17 are snapped together, including door frames 19 (shown in FIG. 13) and placed in position on the sill plate 15. At this point the vertical tie-rods 20 are screwed into the sill plate 15 or a slipper guide 21 forming a part thereof. When the walls 17 are assembled, they are covered with top plates 22 and eave plates 23 which are fastened in place by a nut 24 on the top end of tie-rods 20. The ceiling 26 is then assembled in place.

Figure 7:
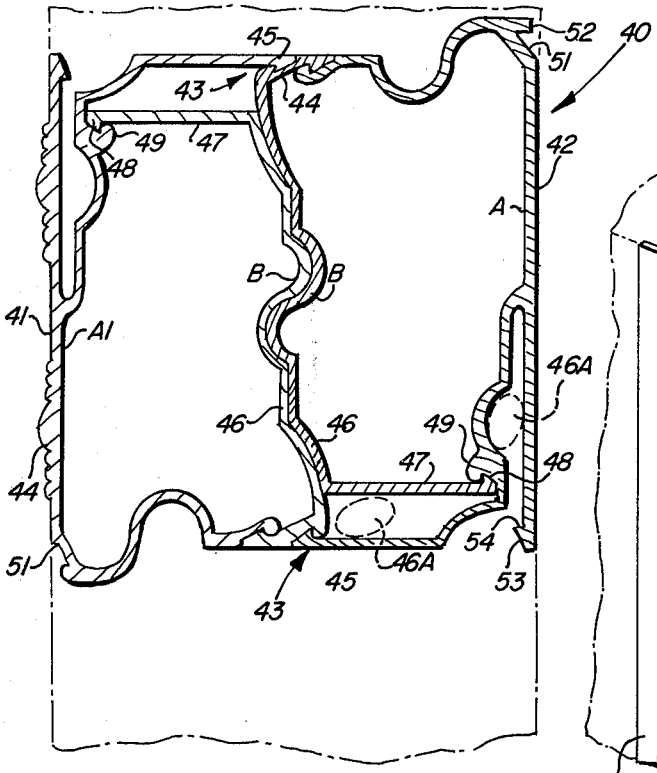
FIG. 7 is a cross-sectional view taken along the line 7—7 of FIG. 1A showing a two piece snap-together multi-layer outer wall configuration.
Figure 20:
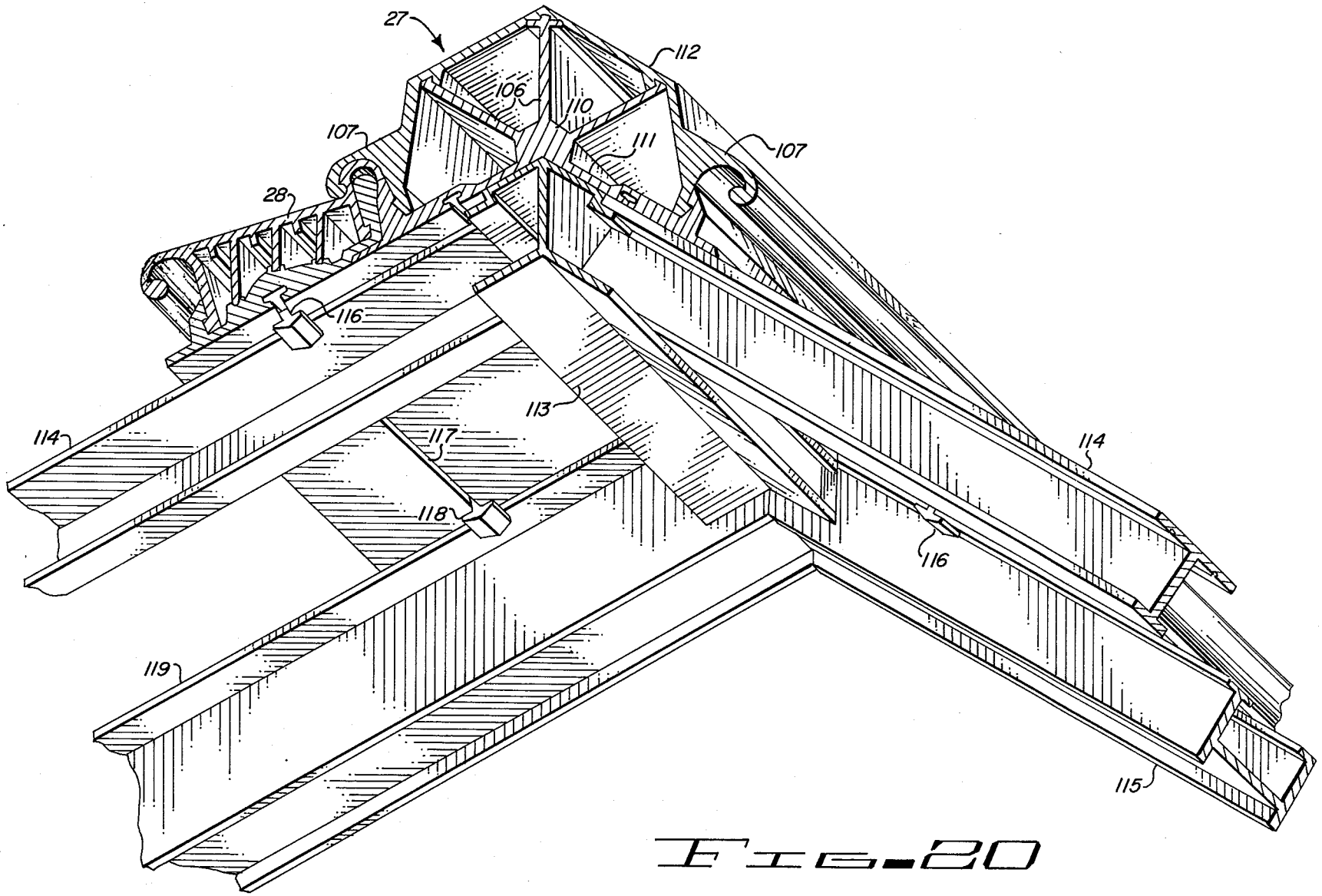
FIG. 20 is a partial perspective view of a roof comb and rafter illustration for the housing complex disclosed.

Pre-cut wall extrusions, hereinafter described, are then snapped together, forming the gable section, which in turn may be capped. A roof comb 27 as shown in FIG. 7 is placed in position across the top of the gable with each roof plate 28 snapped in position from the top down with their ends tied to a gable extension as shown in FIG. 20.

The entire described fabrication is accomplished with the use of one wrench for tightening the nut 24 on the top of the tie-rod and a rubber hammer to help snap the extrusions in place and to drive in the various slide blocks as hereinafter explained.

BUILDING SITE AND FOUNDATION

The building site and foundation need not be any different for the disclosed building structures than for the conventional homes only it need not be as thick, heavy or costly.

The disclosed buildings are designed for mounting on a continuous thin slab of concrete and when this type of construction is used the sill plates hereinafter disclosed may be used with the floor resting on the concrete slab. Where there is a basement or where there is no solid support for the floor, then a different sill plate may be used which in turn supports the floor joint which supports the floor.

SILL PLATE ASSEMBLY

Figure 3:
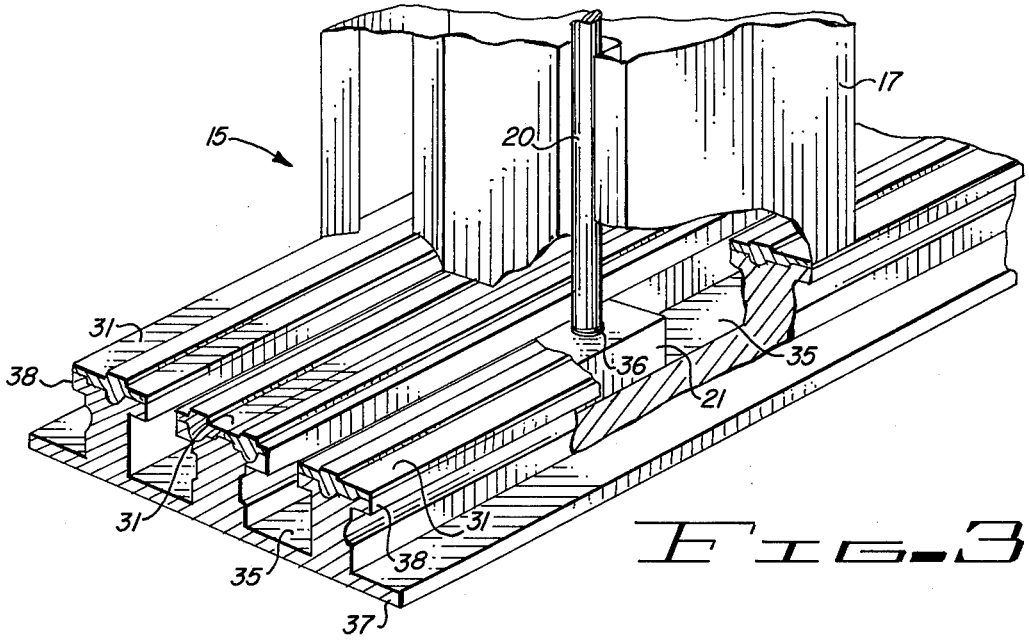
FIG. 3 is a partial perspective view of the outside wall and two track sill plate assembly.
Figure 4:
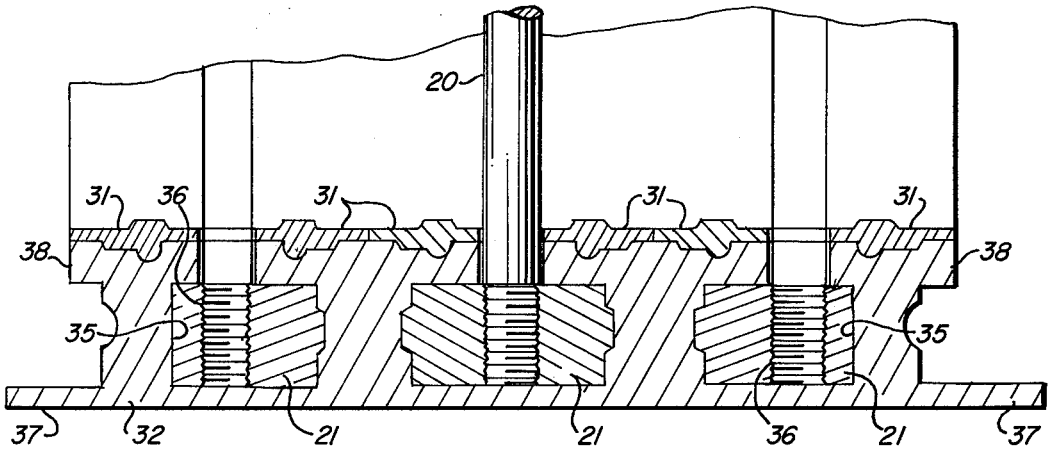
FIG. 4 is a partial cross sectional view of the inside three layer wall and three track sill plate assembly.

The complete sill plate assembly for the multi-story building shown as well as other styles capable of being assembled with the novel multi-layer walls disclosed as shown in FIGS. 2, 3 and 4 comprises a two track sill plate 15 shown in FIG. 3 for supporting the outside two layer wall with the three track sill plate 15A, shown in FIG. 4, used for supporting the inside three layer walls.

As shown in FIGS. 2, 3 and 4 the two and three track sill plates comprise a plurality of identical top extrusions 31 and horizontal extrusions 32 which interlock with the floor and hold it in place, as shown. The sill plates are contoured to hold the associated walls in perfect alignment by providing grooves along their lengths for receiving the bottom ends of the vertical walls 17.

The center portion of the sill plates house deep channels 35 in which is held the slipper guides 21, a solid separate extrusion which is about 18 inches long. A hole 36 is drilled and tapped into this slipper guide to receive the threaded end of the vertical wall tie-rods.

FLOOR PLATES

Figure 5:
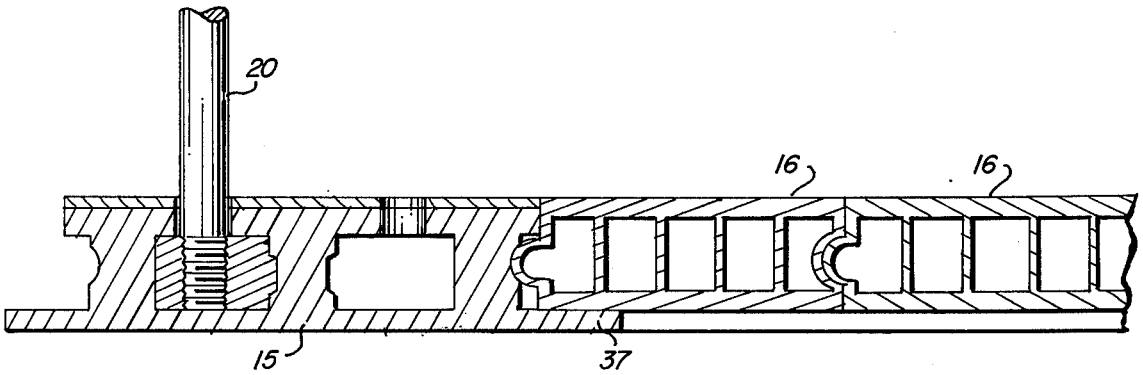
FIG. 5 is an enlarged partial cross sectional view of the floor section joining the sill plate.

After the sill plates are installed the floor plates or extrusions 16 are laid out across the concrete slab or other long lasting separator from one sill plate to another. The floor plates are cut to the proper length for each room and the ends rest on but do not cross over the sill plates 15 and 15A. As shown in FIG. 5, the sill plates have flanges 37 mounted along the inner longitudinal length for supporting the floor plates 16. When installed, the floor plates are further held in place by flanges 38 of these sill plates.

THE WALLS

After the floor is laid the walls 17 are then installed with a corner member 40 afixed first to the sill plate in a corner position as shown in FIG. 6.

The walls 17 of the building structure have been designed and engineered to be the load carrying members through the "stressed skin" process, and carry the main structural load of the building.

The outer walls of the building complex comprises a multi-layer structure formed of two halves or portions 41 and 42. As shown in FIGS. 7 and 8A, 8C and 8D each of the portions 41 and 42 of the multi-layer outside wall is formed from extrude parts A and A-1 and two extruded parts B.

Figure 8:
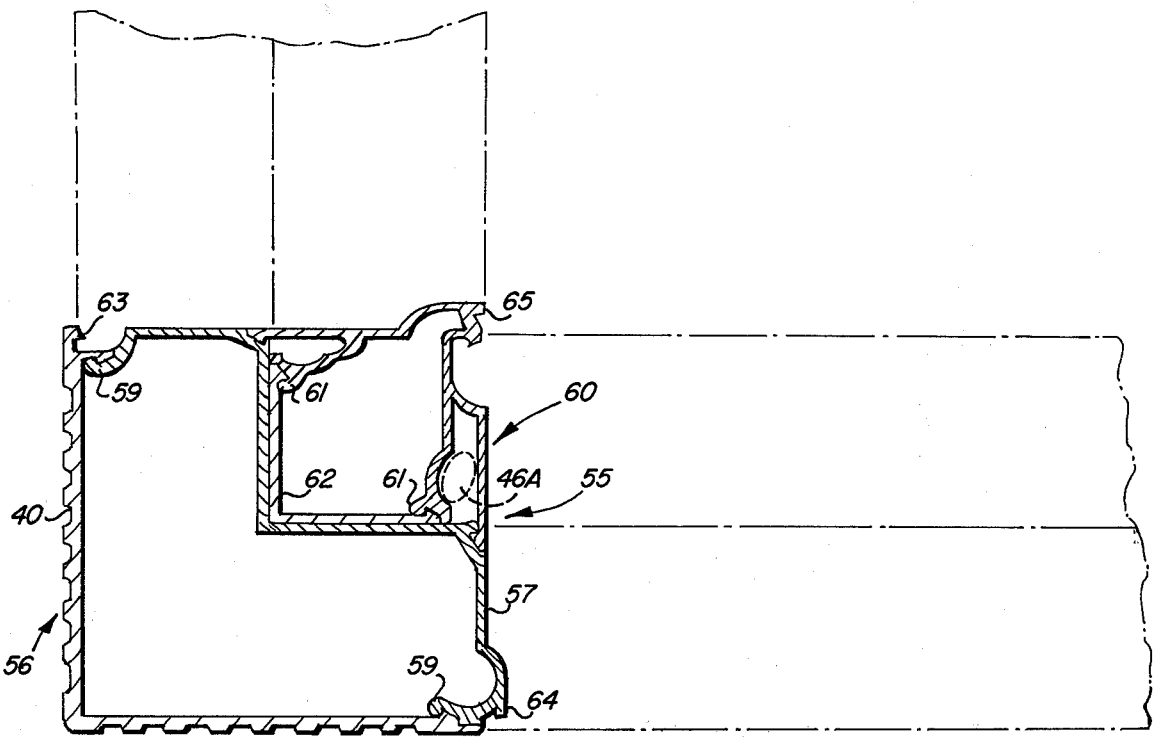
FIGS. 8A–8D show four different extrusions which are used to form the various multi-layer or section wall configuration.
Figure 8A:
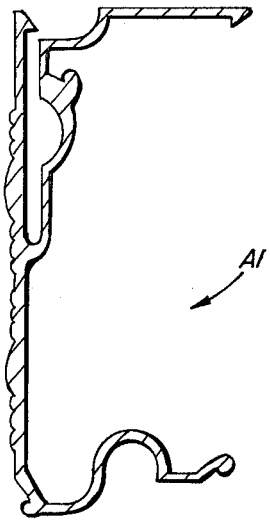
Figure 8B:
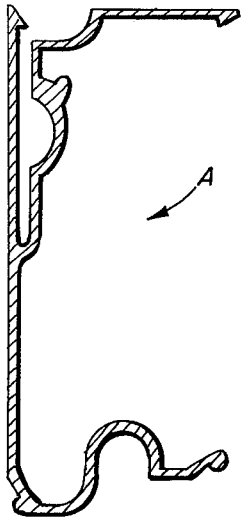
Figure 8C:
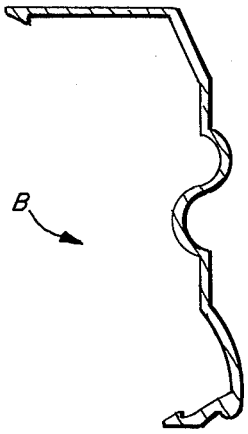
Figure 8D:
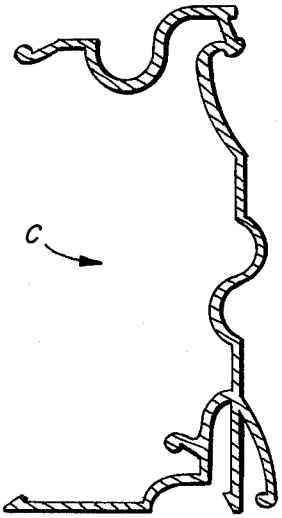

All standard wall members other than the outside corner members are made up from only the four single open extrusions shown in FIGS. 8A–8D. It should be noted that extrusions A and A-1 shown in FIGS. 8A and 8B are of the same die shape other than lines and grooves are placed on the outer wall surface of extrusion A-1 for decorative purposes for the outside walls. Die shape A has a plain smooth surface designated primarily for inside walls but this smooth shape may also be used on the outer wall surface when alternately arranged with extrusion A-1.

As shown in FIG. 7, extrusion B is the back up extrusion for all other wall extrusion forms and is used with extrusion A-1 for a decorative exterior wall finish for portion 41 and with extrusion A for a smooth finish on the inside layer of the wall structure for portion 42 thereof. Extrusion C is used for the center layer of a three layer inside wall structure as hereinafter described.

As shown in FIG. 7, each of the portions 41 and 42 of the wall structure are hingedly connected at 43 and form longitudinally extending semi-cylindrical sockets 44 and mating connectable and disconnectable longitudinally extending, semi-cylindrical pivot portions 45 extending the full length of portions 41 and 42.

Latch devices 46 of the portions releaseably hold the extruded portions 41 and 42 together and comprise resilient hook members 47 having a hook surface 48 adapted to realeasably snap behind the latching surface 49 formed on portions 41 and 42.

Figure 9A:
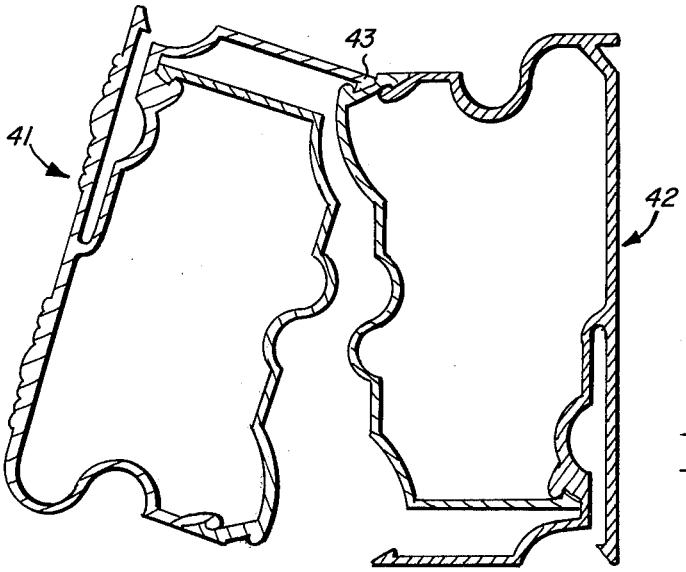
FIG. 9A is a view similar to the view shown in FIG. 7 with one portion of the structure rotated relative to the other for illustrating its snap assembly process.

FIG. 9A shows how the portions 41 and 42 of the wall structure snap together by first interengaging one of the hinge connections 43 and then swinging one of the extruded portions from the broken line position shown in FIG. 9A to the closed latched position shown therein to form one of the basic two-layer wall sections of this invention.

Figure 9B:
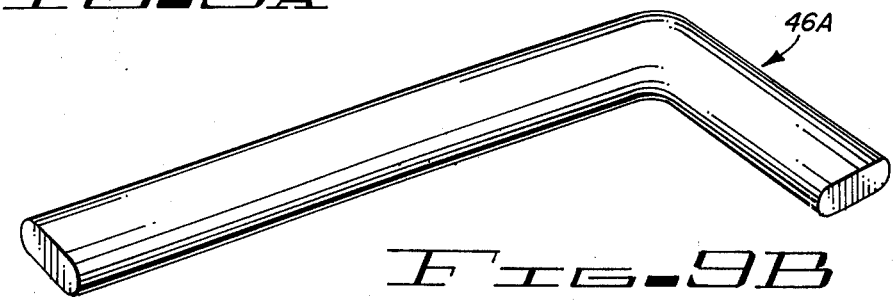
FIG. 9B shows a latch release wrench for use in separating portions 41 and 42 shown in FIG. 7.

A latch release wrench 46A such as shown in FIG. 9B may be inserted between the hook members 47 and the pivot portion 43 of the other extruded portion and rotated by the handle so as to disengage the surfaces 48, 49 and thus allow the portions 41 and 42 to be swung apart and separated.

Figure 10:
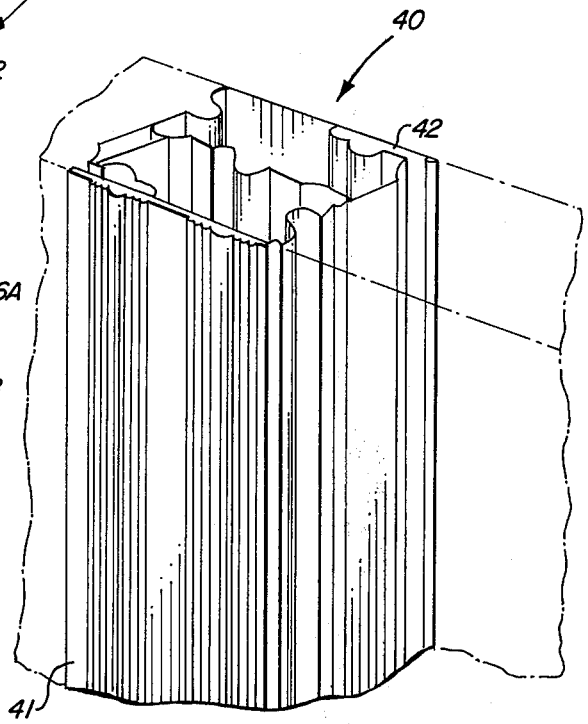
FIG. 10 is a partial perspective view of an outer wall array showing the assembly of a two layer wall structure.

As shown in FIG. 7 the multi-layer or sectioned walls 40 formed as described above, may be snapped together to form a continuous wall or partition 17. To this end, each of the extruded portions 41 and 42 forming a basic individual box element has latching notches 51 with latching surfaces 52 and resilient hook members 53 having a latching hook surface 54 which are interengaged and snapped together to form an assembled building structure such as shown in FIG. 1. The various box sections 40 may be readily released by the use of the wrench heretofore described. FIG. 10 illustrates a portion of a building wall array assembly.

The corner piece shown in FIG. 6 is used for connecting angularly positioned multi-wall sections together for assembling the walls.

As shown in FIG. 6, the corner piece comprises extruded portions 56 and 57 with the outside surface of portion 56 having a decorative surface 58. Each of the extruded portions 56 and 57 has hinge connections at 59 which function in the same manner as hinge connection 43 of FIG. 7, and for simplicity's sake will not be described in further detail. A third extruded portion 60 fills out the corner box element and provides hinge connections 61 for interlocking with a filler portion 62 spaced between portions 57 and 60, as shown.

FIG. 6 illustrates resilient hook members 63, 64 and 65 provided on portions 56, 57 and 60 for interlocking with portions 41 and 42 of FIG. 7 to form an integrated structure.

The corner box elements 50 are interconnected with the walls 17 and these structures are then joined with the sill plate 15 through the use of slipper guides 21, as shown in FIGS. 3 and 4. These walls 17 are rigidly connected and held firm along their entire length by corner pieces. Each wall is prevented from rising above or falling below the other wall by the simple, solid, and secure connection of the sill plate 15 when one wall section joins another. The slipper guide 21 of wall sill plate 15 extends out over and into a channel or recess on the side of the other wall sill plate 15, and is held in place by the tie rod 20. This tie rod 20 is placed behind the first wall member, where it will not interfere with the adjoining wall top plate 23.

Figure 11:
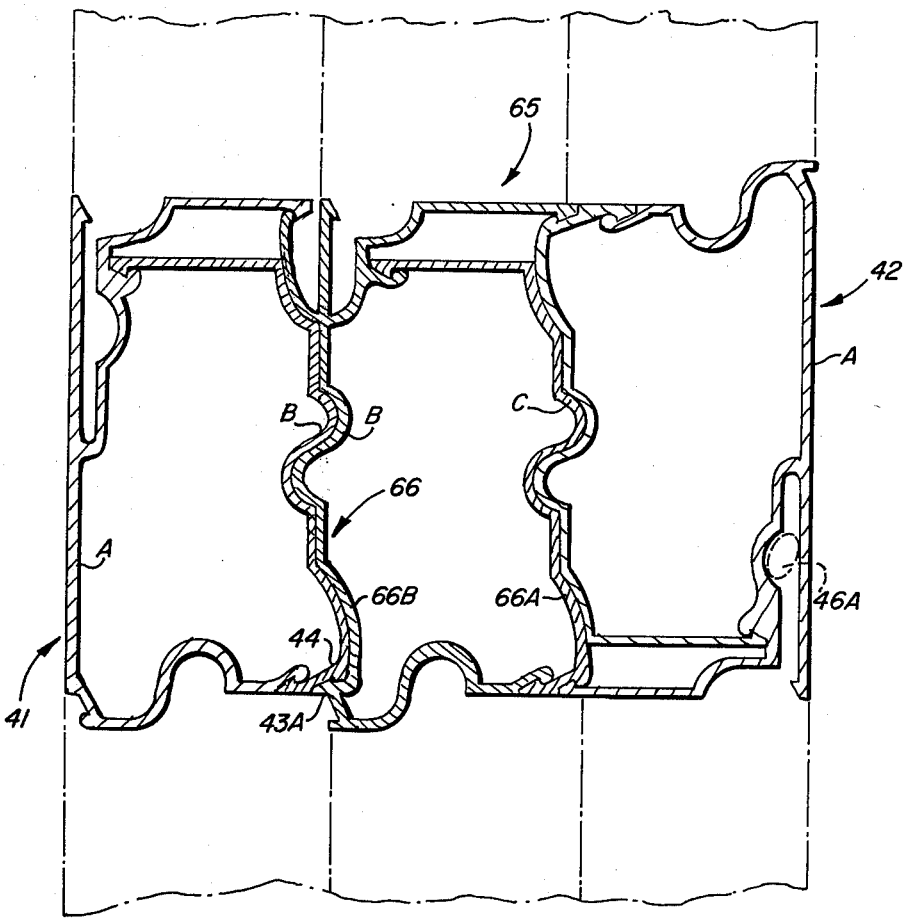
FIG. 11 is a cross-sectional view showing a snap-together wall structure for forming a three layer inner wall configuration of a multi-story building configuration.
Figure 12:
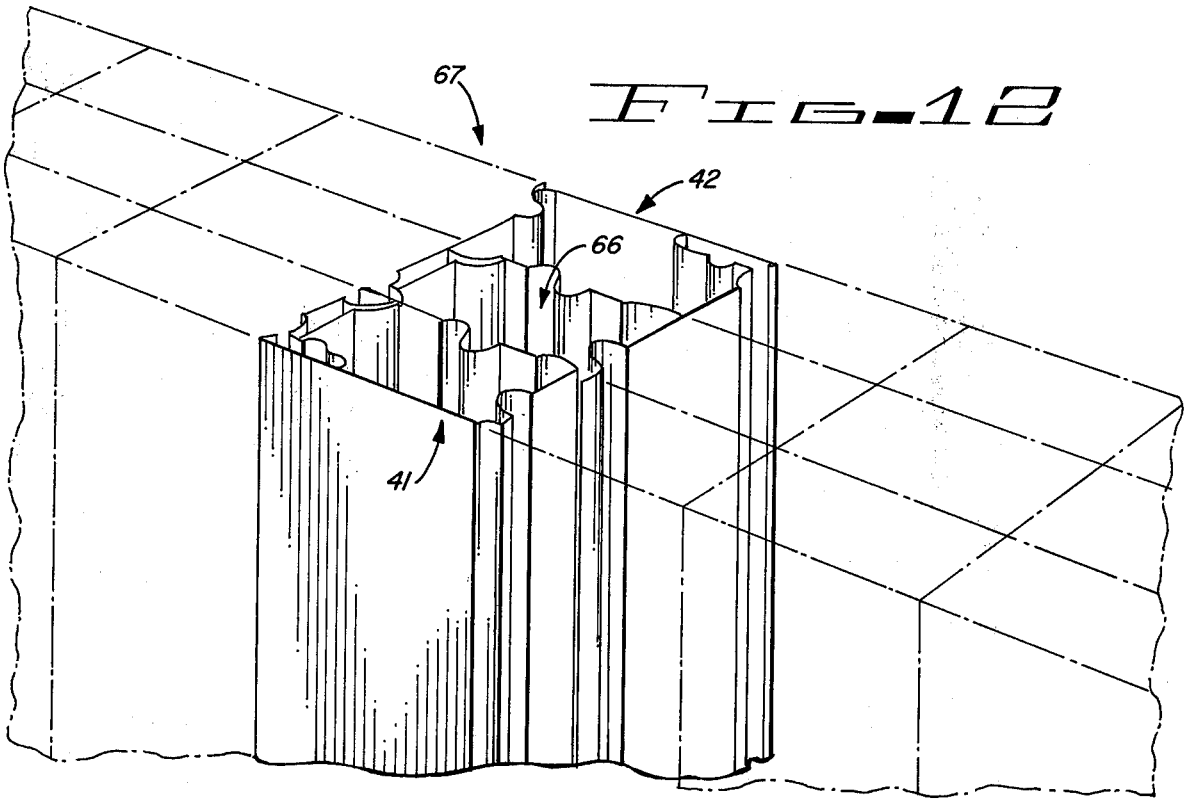
FIG. 12 is a partial perspective view of the threelayer inner wall configuration shown in FIG. 11.

FIGS. 11 and 12 illustrate a three layer inside wall structure 65 comprising three portions 41, 42 and 66 formed from two die extrusions A, three die extrusions B and one die extrusion C all shown in FIGS. 8A–8D.

As shown in FIG. 11, extrusion B is the back up extrusion for both of the extrusions A as well as extrusion C.

Each of the portions 41, 42 and 66 are hingedly connected at 43 in the manner heretofore described for the construction of the outer wall structures with portion 66 interconnecting portions 41 and 42. The same latch release wrench shown in FIG. 9B can be used to disconnect the three section wall portion when assembled and the portions are interconnected in the manner heretofore described for the two layer wall structure.

FIG. 12 illustrates the three extruded portions 41, 42 and 66 in a three layer wall array 67.

The tie rods 20 integrate these walls into a strong, solid construction and can be placed anywhere and as many as needed. Thus, the wall sections are all locked to each other completely from the top to bottom of the wall structure and prevent end play. In most installations the tie rods are needed only in the outside layer of the two layer outside wall, as shown in FIGS. 2, 3 and 4, and in the center layer of the three layer inside wall leaving the other sections or layers of the wall configuration for supporting the ceiling and second floor of the building complex.

WINDOW AND DOOR INSTALLATIONS

Windows and doors are built into the wall structure during assembly after the right number of full length wall members have been installed between the corner and the window frame installation. Short wall pieces are installed the full width of the window which act as the window foundation and these short wall pieces are then joined by a standard full length wall piece for the continuation of the wall.

Figure 13:
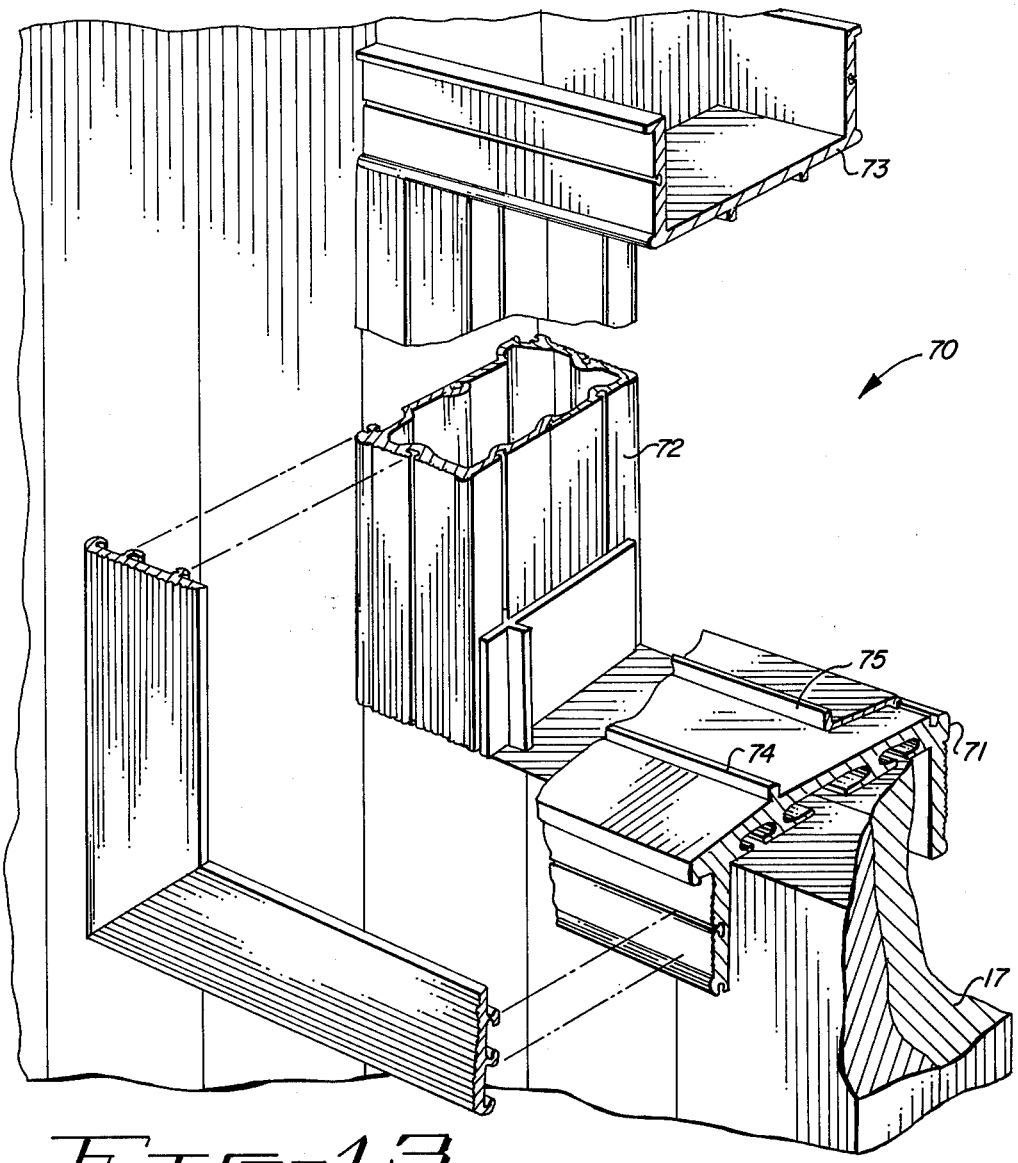
FIG. 13 is a partial perspective view of a window installation used in the building complexes disclosed.

FIG. 13 discloses a partial perspective view of a window frame 70 for a two-story building which differs from a single story building in that the exterior wall 17 of the two-story building is thicker than the wall of a single-story building. The four basic members used for this prefabricated window frame structure comprise a window sill 71, two identical side frames 72 and a top plate 73. The window sill and top plate are single open members while the two side frames are two halves pressed together with or without insulation packed therebetween. The two window side frames are identical and each will fit either side of the window opening since they are formed from the same die.

The window glass is premounted in an aluminum sub-frame, and this sub-frame is mounted in the rail opening formed on the window sill 71 by flanges 74 and 75 and is accomplished by simply pressing into the rail the window from inside the building. This operation requires no tools and may be done any time that it is convenient after the walls and window frames have been installed.

The sub-frame of the window may contain a single pane of glass or it may contain two panes of glass with a dead air space inbetween.

Figure 15:
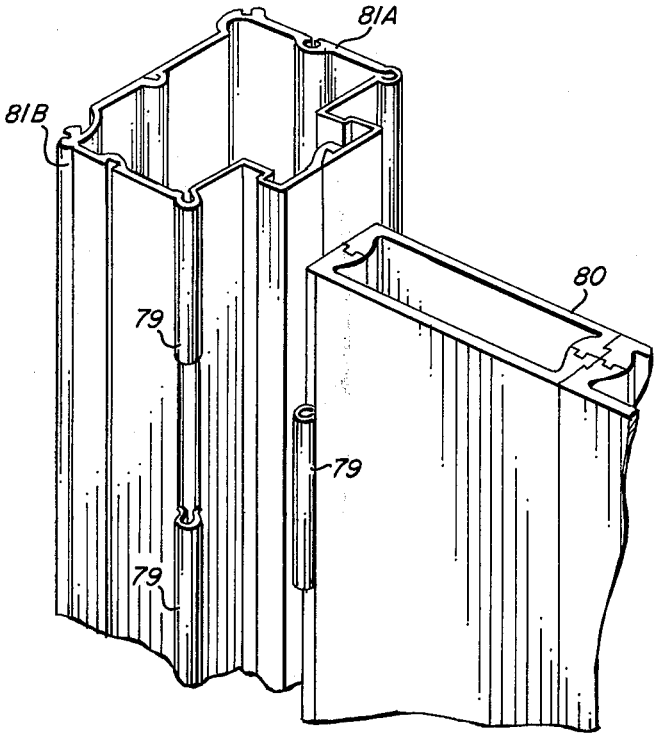
FIG. 15 is a partial perspective illustration of a three layer wall door frame for the door assembly.
Figure 14:
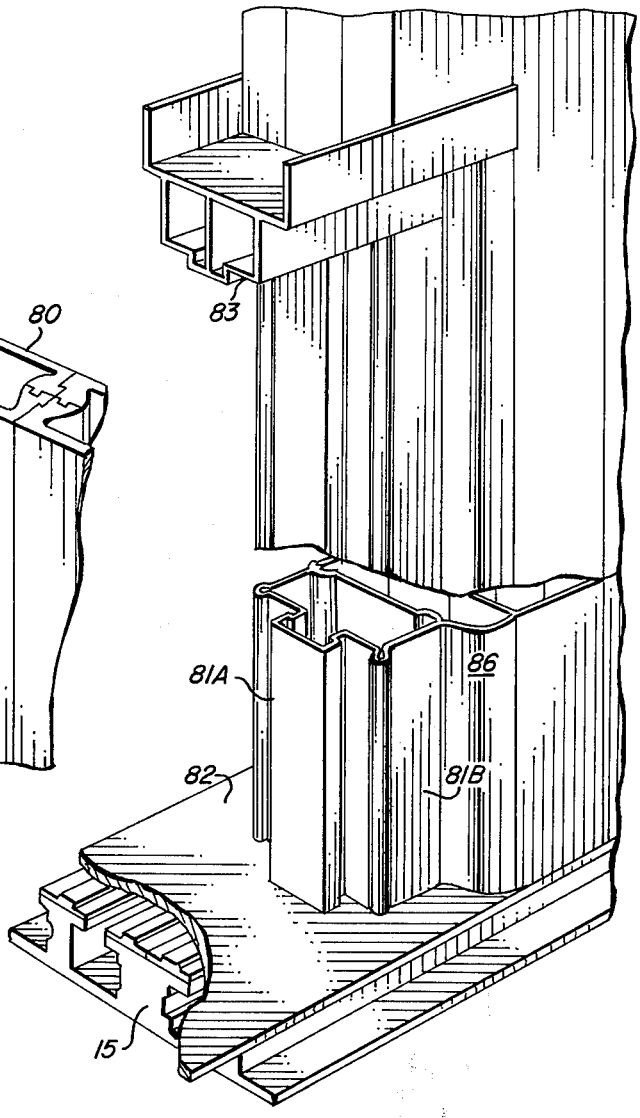
FIG. 14 is a partial perspective view of a door frame for the building complexes disclosed.
Figure 16:
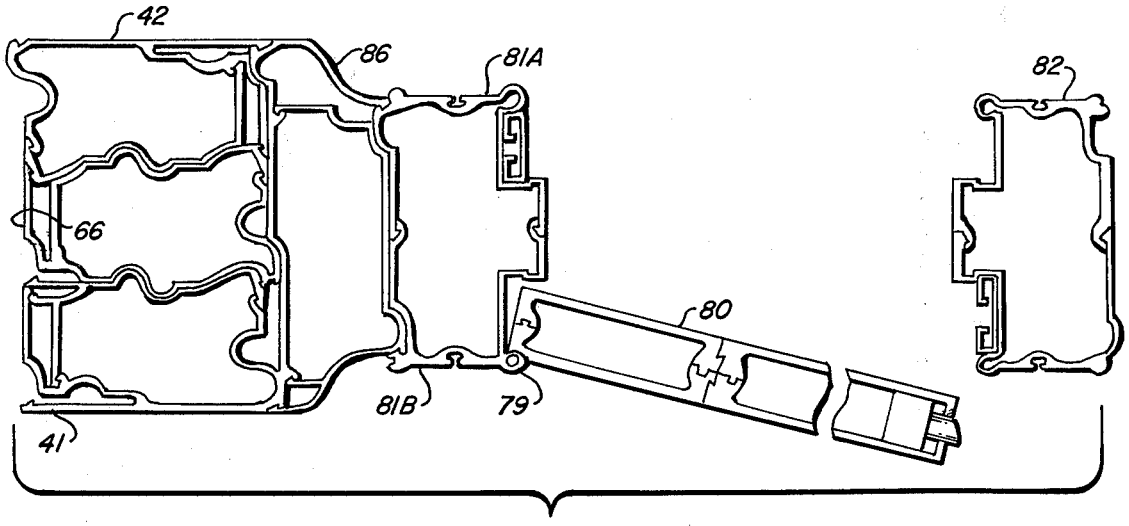
FIG. 16 is a partial cross-sectional view of the inside door and door frame assembly.

FIGS. 14–16 disclose a partial perspective view of a door frame assembly 78 for a two-story building complex wherein the same dies are used whether it is an outside or inside door with minor changes in assembly.

The door frames require no prefabrication or preassembly other than the cutting of the half hinge 79 on one of its members, as shown in FIG. 15, to hand the door 80. This half hinge cut is matched by a half hinge cut in the door itself. Since the two door frame sides 81A and 81B form part of the door frame assembly 78 and come from the same die, they are identical and will fit either side of the door opening.

The door frame assembly further comprises a door sill 82 and a door frame top 83. These frame parts are assembled one member at a time along with the walls and when finished become a part of the wall itself.

When the disclosed door frame is utilized for a three layer wall, such as an inside wall, a door frame adaptor 86, shown in FIG. 16, is installed between the three layer wall and the door frame 82 as a filler plate and this feature makes the same door frame adaptable throughout the building complex. The door frame adaptor, as shown, is made in two halves pressed together so it can be prepackaged with insulation to prevent noise transmital from room to room.

CEILING AND FLOOR INSTALLATION

Figure 17:
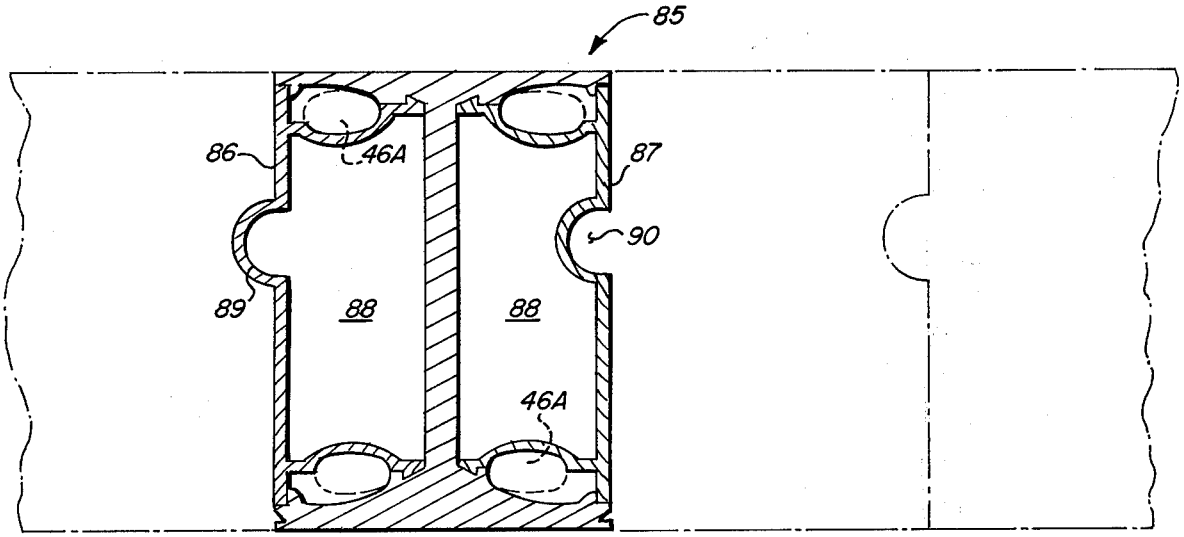
FIG. 17 illustrates a partial cross-sectional view of the flooring elements of the ceiling or second or higher floors of the disclosed building complexes.

FIG. 17 illustrates a very strong but lightweight boxed in I-beam 85 which may serve as both the ceiling for the first story of a multi story building and the floor for the second story of the building. The boxed in I-beam comprises a pair of similar extruded portions 86 and 87 which are held together in a boxed in form as shown. The hollow interior 88 may be packed with suitable insulating material if so desired during the assembly process. The extruded portions interlocking with the I-beam may be provided with a tongue 89 and groove 90 which may be offset, if so desired, so they can be installed only one way.

As illustrated in FIG. 2, a support plate 91 is installed by placing it on top of the eight foot wall members. This member is used to support the ceiling of the second story of the multi floor building or the upper floors of a multi-story building.

Figure 18:
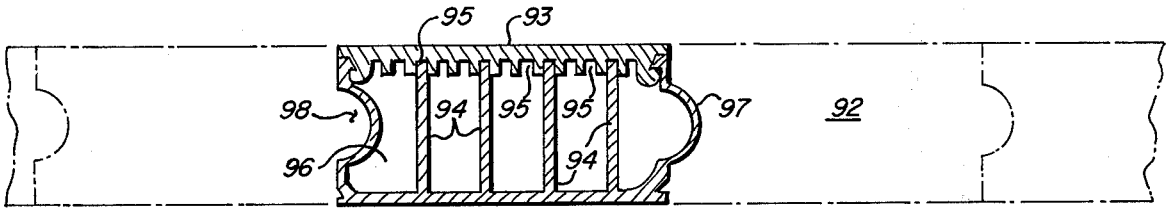
FIG. 18 is a partial cross-sectional view of the first floor of a building formed according to this invention.

Since the first or lower floor of the prefabricated building disclosed does not require the strength, size and mass as the I-beams 85 disclosed in FIG. 17, a lighter, more compact member 92 shown in FIG. 18 is designed which will permit a lower, lighter and more stable sill plate under the walls of the building. This type of member is particularly ideal for the bottom floor of a town house that is mounted on a concrete slab and comprises an extruded, elongated member 93 having a plurality of space supports 94 which interlock with matching grooves 95 formed therein, as shown in FIG. 18. When mounted in the horizontal position as shown, it provides the rigidity necessary for a floor or roof member. The space 96 may be prepacked with insulation if so desired. It should be noted that this flooring member is so formed that the elongated member 93 is provided with a tongue 97 and groove 98 for interlocking with other similar flooring members.

STAIRWAY INSTALLATION

Figure 19:
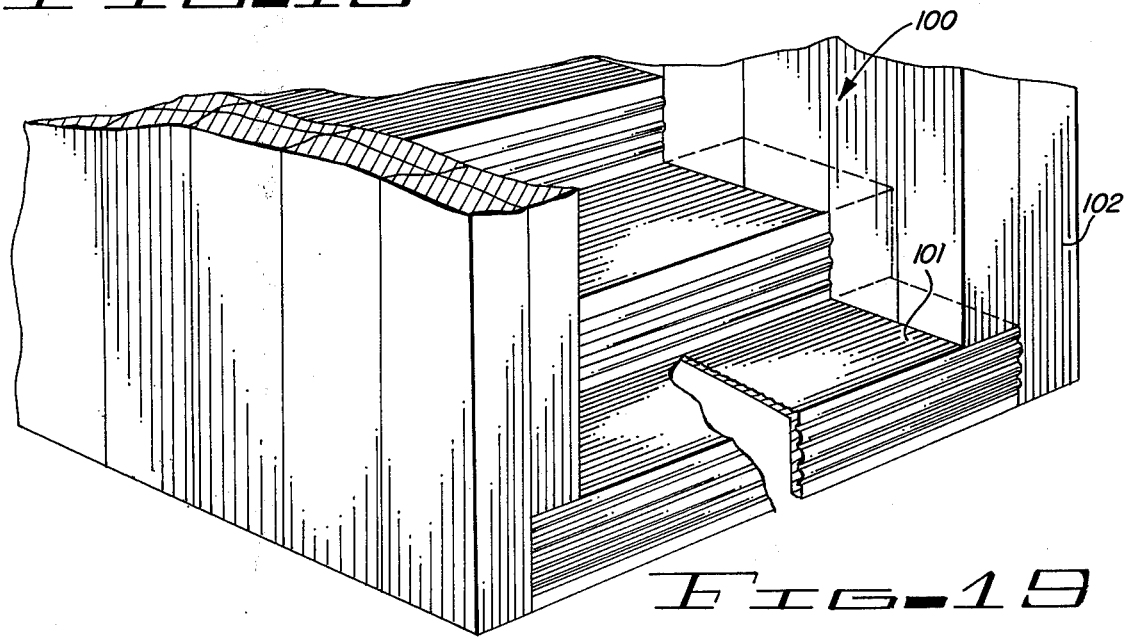
FIG. 19 is a partial perspective of a stairway and wall connectors for the building complex disclosed.

FIG. 19 discloses a prefabricated stairway or wall connector 100 and comprises pre-cut tread sections 101 which are installed between two multiple layer walls 102. These tread sections are pre-cut to the length of the required stairway that is needed plus approximately a 6½ inch overlap and it is installed between two multiple layer walls by simply laying each piece on top of the first wall layer on each side of the stairway. For both simplicity and strength the tread section is made quite thick and extends back onto the first wall layer about 3¼ inches on each side of the stairway. After these stair steps are laid in position, they are secured by installing the wall sections that go above the stairway, thereby placing the weight of the walls and their load on the end of these steps so that they are well secured.

THE ROOF

A roof section of strong, rigid assembly is utilized with the snap-on method of construction similar to the wall section. With this type of construction, the roof is maintenance free; it will never have to be refinished and is completely water-tight. The installation is fast and simple and is a perfect application of stressed skin construction on every square inch of roof section.

FIG. 20 discloses a main roof comb 27 constructed with reinforcing ribs 106 for great strength so as to carry the main load of the roof. Slide hook portions 107 receive the roof members 108 which are hooked onto each side and interlocked therewith to extend downwardly therefrom along the roof, and each succeeding roof member is hooked onto the preceding roof member down to a final roof member 109 shown in cross-section in FIG. 21A or to any other suitable final roof piece member. Thus, all roof members are held in traction from the top comb on down to the final roof piece.

As noted from FIG. 20, the roof comb 27 comprises an elongated crest member 110 extending along the crest of the roof from which a pair of elongated, angularly disposed bottom surfaces or support members 111 extend downwardly from the crest member along each side of the crest of the roof to conform to the slope of the roof. The reinforcing ribs 106 are arranged to extend radially outwardly and upwardly from the crest member 110 between the bottom surfaces 111 and support and interlock on their free ends with an elongated, rib-enclosing arcuate cover or outer surface 112. The cover is fastened to and encloses the outer ends of the ribs. The side hook portions 107 are formed by the arcuate cover 112 along different sides of the support members for receiving roofing members 28 of the roof in dependent fashion, as shown. Thus, the reinforcing ribs 106 protruding from crest member 110 extend between crest member 110 and the rib enclosing outer cover or surface 112 and are within the apex formed by the main roof comb and more particularly the outer cover surface 112 thereof.

Provided under and supporting the roof comb 27 is a subcomb 113 having upwardly facing, angularly disposed surfaces for engaging and supporting the upper ends of the metallic roof rafters 114. The subcomb is supported by gable 115 (shown in FIG. 21A). The gable comprises pieces that are cut to fit and go on top of the end walls formed by the two layer box elements heretofore described with one on each side of the gable end of the building. The roof members 28 rest directly on and are fastened to the gables with the gables in turn being secured to the walls by suitable tie rods and nuts, secured to the building foundation in a manner heretofore described for the side walls of the building structure.

The metal roof rafters 114 may be attached to the subcomb at the top and the eave plate at the bottom by suitable slide locks 116 mounted in the underside of the rafters themselves for quick assembly and disassembly or by suitable metal screws or rivets. The roof is then fastened to these rafters and the gable plate in the same way.

Figure 21A:
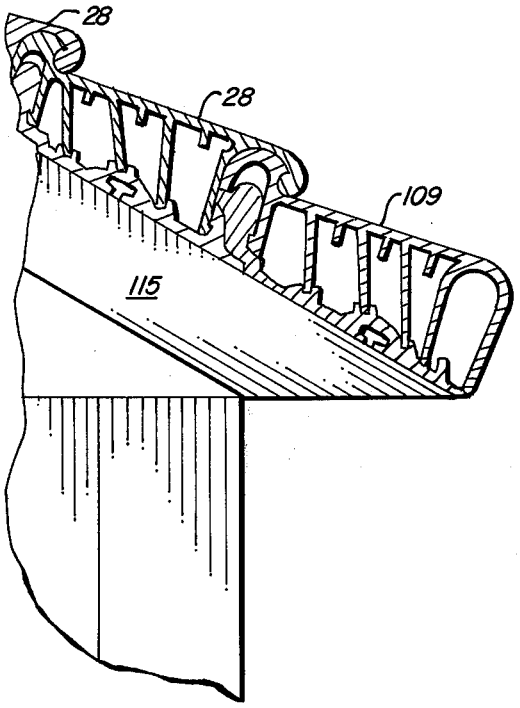
FIG. 21A is a partial view of a roofing final member.
Figure 21B:
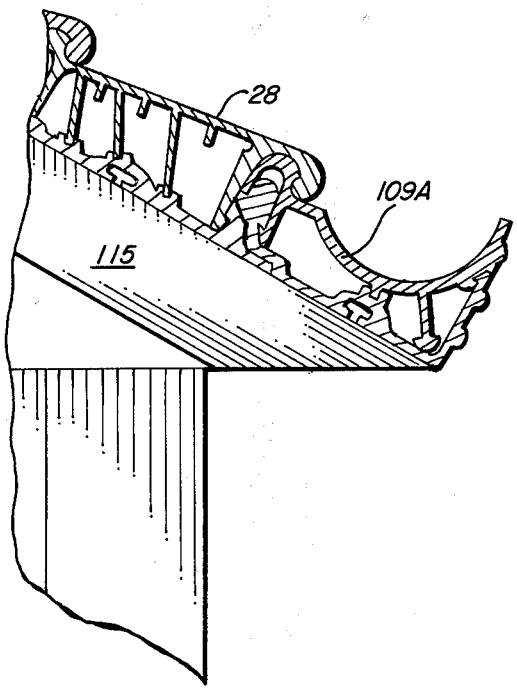
FIG. 21B is a partial view of a roofing drain trough.

The final roof member 109 as shown in FIG. 21A or a drain trough 109A as shown in FIG. 21B, if preferred, is simple, fast to assemble and durable, and comprises two halves which snap together as shown. This permits the roofing parts to be prepackaged with the bottom half of the final roofing member to use the same die as is used for the bottom half of the roofing member 28.

After the comb plate 27 is in position, the first roof plate 108 on each side is snapped in place by hooking into the comb plate and pressing down. Each succeeding roof plate 28 is hooked into the next one and pressed down the same way. The last piece to be put in place is the combination final roof member 109 or a roof drain plate, if so desired.

Each individual roof member 28 is not only fastened into the next one, it is also individually held down by its own slide lock 116 which is mounted in the channel 117 on the bottom of each roof member. This slide lock need be only about six inches long with the top side of one end cut away as shown leaving a shoulder or lip 118 which will extend under a flange 119 that is made on the top side of the gable plate just for that purpose. As the roof is being installed, one of these slide locks 116 is placed in the channel at each end of each roof member. When the roof member is pressed into its place, this slide lock 116 is simply slid along until the trimmed end extends under the flange on the gable extrusion and from the inside of the wall end. Each piece is thus locked into position before the next piece is brought up for positioning on the structure. For disassembling (if ever need be), this slide lock is simply pulled free of the gable plate and roof member 108 is simply turned up on edge from the lower side, then simply lifted free.

Although but a few embodiments of the present invention have been illustrated and described, it will be apparent to those skilled in the art that various changes and modifications may be made therein without departing from the spirit of the invention or from the scope of the appended claims.

What is claimed is:

1. A metallic building erected from interlocking elements comprising in combination:

a sill plate for mounting on a substantially horizontal surface, a slipper guide longitudinally positionable in said sill plate, tie-rods demountably secured to and extending vertically upwardly from said slipper guide, a series of upstanding, interlocking elongated wall extrusions supported on their ends side by side on said sill plate, embracing said vertical tie-rods at the interlocking junction of said wall extrusions and comprising an inside portion and an outside portion, said inside and outside portions defining cooperating demountable hinge connections, each of said hinged connections comprising a pair of hinge portions spacedly arranged on the inside extruded portion and on the outside extruded portion, one of said hinge portions on said inside extruded portion cooperating with one of said hinged portions on said outside portion to form said hinged connection, at least one latch device comprising cooperating members one on each of the extruded portions and demountably interconnected between the extruded portions, the extruded portions being swung together on either one of their hinged portions and snapped and swung together positioned by the latch device to form the wall extrusions, an eave plate secured by clamping means on the upper end of said tie-rod to the top of said wall extrusions, floor extrusions supported on horizontally inwardly projecting flanges of said sill plate, the inside portions of said wall extrusions extending vertically the height of a room of the building, with the surfaces of said inside portions serving as the inside wall of the room and the upper ends of said inside portions serving as a support for a second story floor of said building, outside portions of further wall extrusions being positioned in end-to-end alignment with said outside portions of said wall extensions forming the first floor of the building, inside portions of said further wall extrusions arranged in spaced end-to-end alignment with said inside portions forming a part of the first floor wall extensions to form the walls of the rooms of the second floor of the building, a ceiling for the rooms in the building mounted on the upper ends of said inside portions of said further wall extensions, said further wall extrusions and said ceiling supporting a roof comb, a roof comb comprising an elongated crest member fitted for extending along the crest of the roof of the building, a pair of elongated support members arranged to extend angularly downwardly from said crest member along each side of the crest of a roof, at least a pair of reinforcing ribs extending outwardly and upwardly from said crest member, an elongated cover arranged to extend along said support members, said cover being fastened to and enclosing the outer ends of said ribs, said cover defining back portions at its peripheral edge on each side of the crest for receiving and supporting roofing members of the roof in dependent fashion, and a frameless hollow portion wall panel arranged between floor and ceiling of a room in the building comprising an extruded inside panel portion, an extruded outside panel portion parallelly positioned to said inside panel portion, inner portions arranged between said inside and said outside panel portions with one juxtapositioned to each of said inside and outside panel portions, each of said inside and outside panel portions and inner portions comprising a pair of hinge elements spacedly arranged thereon, said hinge elements on said inside and outside panel portions cooperating with hinge elements on a different one of said inner portions to form hinge connections, the combined inner portion and inside panel portion and the other inner portion and outside panel portion forming a pair of cooperating wall layers.

2. A frameless hollow wall structure formed of a plurality of extrusions comprising:

an inside portion, an outside portion parallelly positioned to said inside portion, and an inner portion arranged in juxtapositioned parallel arrangement between the inside and outside portions, said inside and outside portions each comprising an extrusion of substantially similar geometrical configuration and each having an identical back up extrusion spaced from and hingedly connected to the inside and outside portions, said inner portion comprising a third back up extrusion similar to said back up extrusions of the inside and outside portions and a third extrusion having latch means spaced from and hingedly connecting to said third back up extrusion by said latch means, said inner portion having latch means connecting said inside and outside portions to form the hollow wall structure, said inside portion and said outside portion having their back up extrusions juxtapositioned and in surface engagement with one of said third back up extrusions or said third extrusion of said inner portion, the back up extrusions of the inside, outside and inner portions, and said third extrusion being contoured to prevent lateral movement of the pivotally connected portions of the wall structure said latch means of said extrusions having a portion for hingedly connecting said extrusions for movement during assembly.

* * * * *